US007067559B2

(12) United States Patent
Bhatt et al.

(10) Patent No.: US 7,067,559 B2
(45) Date of Patent: Jun. 27, 2006

(54) PROCESS FOR THE PRODUCTION OF LIQUID HYDROCARBONS

(75) Inventors: Bharat Lajjaram Bhatt, Fogelsville, PA (US); Dirk Coenraad Engel, Amsterdam (NL); Edward Clyde Heydorn, Macungie, PA (US); Matthijis Maria Gerardus Senden, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/482,724

(22) PCT Filed: Jul. 3, 2002

(86) PCT No.: PCT/EP02/07534

§ 371 (c)(1),
(2), (4) Date: Jun. 17, 2004

(87) PCT Pub. No.: WO03/004582

PCT Pub. Date: Jan. 16, 2003

(65) Prior Publication Data

US 2004/0235966 A1 Nov. 25, 2004

Related U.S. Application Data

(60) Provisional application No. 60/302,947, filed on Jul. 3, 2001.

(51) Int. Cl.
*C07C 27/00* (2006.01)

(52) U.S. Cl. ..... 518/700; 518/715

(58) Field of Classification Search ..... 518/700, 518/715

See application file for complete search history.

(56) References Cited

U.S. PATENT DOCUMENTS 5,324,335 A 6/1994 Benham et al.
5,407,644 A 4/1995 Rytter et al.
5,770,629 A 6/1998 Degeorge et al.
6,344,490 B1 * 2/2002 DeGeorge et al. ..... 518/700

FOREIGN PATENT DOCUMENTS

| | | |
|---|---|---|
| DE | 3245318 | 6/1984 |
| EP | 0 450 859 | 10/1991 |
| EP | 0 592 176 | 4/1994 |
| EP | 0 609 079 | 7/1998 |
| GB | 2281224 | 3/1995 |
| WO | 94/16807 | 8/1994 |
| WO | 97/12228 | 4/1997 |
| WO | 00/43098 | 7/2000 |
| WO | 00/45948 | 8/2000 |

OTHER PUBLICATIONS

Gas-liquid-solid fluidization engineering, L. -S. Fan, Butterworth, Stoneham (1989).
Chemical Reaction Engineering, O. Levenspiel, Wiley and Sons, NY (1972).

* cited by examiner

*Primary Examiner*—J. Parsa

(57) ABSTRACT

The present invention concerns a process for the preparation of liquid hydrocarbons which process comprises contacting synthesis gas with a slurry of solid catalyst particles and a liquid in a reactor vessel by introducing the synthesis gas at a low level into the slurry at conditions suitable for conversion of the synthesis gas into liquid hydrocarbons, the solid catalyst particles comprising a catalytic active metal selected from cobalt or iron on a porous refractory oxide carrier, preferably selected from silica, alumina, titania, zirconia or mixtures thereof, the catalyst being present in an amount between 10 and 40 vol. percent based on total slurry volume liquids and solids, and separating liquid material from the solid catalyst particles by using a filtration system comprising an asymmetric filtration medium (the selective side at the slurry side), in which filtration system the average pressure differential over the filtration medium is at least 0.1 bar, in which process the particle size distribution is such that at least a certain amount of the catalyst particles is smaller than the average pore size of the selective layer of the filtration medium. The invention also comprises an apparatus to carry out the process described above.

27 Claims, No Drawings

PROCESS FOR THE PRODUCTION OF LIQUID HYDROCARBONS

This application claims the benefit of Provisional Application Ser. No. 60/302,947, filed Jul. 3, 2001.

GOVERNMENT RIGHTS

The U.S. Government has a paid-up license to this invention and the right in limited circumstances to require the patent owner to license others on reasonable terms as provided for by the terms of DOE contract DE-FC-22-95PC93052 awarded by the Department of Energy.

FIELD OF THE INVENTION

The present invention relates to a process for the preparation of liquid hydrocarbons by contacting synthesis gas in a reactor vessel with a slurry of solid catalyst particles and separating the liquid hydrocarbons thus prepared from the catalyst particles by means of filtration.

BACKGROUND OF THE INVENTION

Three-phase slurry reactors are known in the art, especially for carrying out highly exothermic, catalytic reactions. These reactors have a liquid phase in which solid catalyst particles are dispersed or held in suspension by a gas phase bubbling through the liquid phase. These reactors provide improved heat transfer characteristics for the exothermic reaction, and the bubbling gas provides essentially all of the energy necessary for maintaining the catalyst dispersed in the liquid phase. Stirring or agitation by mechanical means is sometimes used, while additionally a slurry or liquid recycle may be in operation. These bubble column reactors usually comprise a shell-type housing in which a multiplicity of vertically arranged or spirally wound tubes is contained, the tubes being filled with a heat transfer medium, e.g. water and/or steam, which absorbs the heat generated by the exothermic reaction. Usually the reactor comprises a free-board zone located above the slurry zone, which zone contains substantially no slurry, but primarily gaseous products and/or reactants. See for some general literature about three phase slurry reactors Gas-liquid-solid fluidization engineering, L.-S. Fan, Butterworth, Stoneham (1989), and Chemical Reaction Engineering, O. Levenspiel, Wiley and Sons, New York (1972).

The synthesis of hydrocarbons from synthesis gas, i.e. a mixture of hydrogen and carbon monoxide, is well known in the art as the Fischer-Tropsch hydrocarbon synthesis. The reaction is carried out in the presence of a catalyst, usually a group VIII metal catalyst supported on a catalyst carrier. The Group VIII metal is preferably chosen from iron, nickel, cobalt and/or ruthenium, more preferably iron or cobalt. The catalyst carrier is suitably an inorganic refractory oxide, preferably alumina, silica, titania, zirconia or mixtures thereof. Most of the hydrocarbons produced in the Fischer Tropsch reaction are usually in the liquid state under reaction conditions. Preferably heavy hydrocarbons are made, especially $C_{12}$ and higher, more especially $C_{20}$ and higher, although also hydrocarbons are produced which are gaseous under the reaction conditions. Further, water is produced, which is mainly present in the gaseous phase at the reaction conditions.

The Fisher-Tropsch reaction may be carried out in a fixed bed multi-tubular reactor or in a fixed bed comprising spirally wound cooling tubes, but can, in view of a more efficient heat transfer, also be carried out in a three phase slurry reactor.

A number of ways have been proposed to separate liquid, especially liquid hydrocarbons reaction products produced in a Fischer Tropsch reaction, from the slurry in a three phase slurry reactor.

Thus, European patent application 609 079 describes a slurry bubble column containing a slurry bed of catalyst particles suspended in a liquid. A filtration zone is located in the slurry bed, in particular close to the upper surface of the slurry bed. The filtration zone typically comprises a plurality of filter elements. The filter elements are typically of elongated cylindrical form and comprise a cylindrical filtering medium enclosing a filtrate collection zone. The filtration results in the formation of a cake, which is removed by back flushing. No indications are given which avoid the building of a cake layer.

European patent application 592 176, describes a filtration zone consisting of a tube sheet holding filter cartridges. The tube sheet defines the upper surface of the slurry bed. No specific indications are given which avoid the building of a cake layer.

International (PCT) application No. 94/16807 describes a filtration zone surrounding the slurry bed. No cake build-up is observed because a very low mean pressure differential is used over the filter elements. A critical value of 6 mbar is mentioned in the description.

UK patent application 2 281 224 discloses a reactor containing a plurality of reaction tubes arranged to accommodate the slurry bed. The upper part of each contains a filter element to separate hydrocarbon product slurry, and a top part of increased diameter, often referred to as a disengagement zone, to separate gas from the slurry. No cake build-up is observed because a very low mean pressure differential is used over the filter elements. A critical value of 6 mbar is mentioned in the description.

U.S. Pat. No. 5,324,335 describes the preparation of hydrocarbons using an (unsupported) iron catalyst. To avoid the continuous increase in slurry height in the reactor vessel, wax is separated from the slurry using a cross-flow filter located outside the reactor vessel. Filter cake is regularly removed by pressurising the filtered wax on the shell side of the filter with an inert gas to bump the cake into the slurry stream.

German patent 3,245,318 describes a process for separating a liquid product stream from a slurry, by cross-flow filtration, which is carried out at substantially reactor pressure, but outside the reactor. Regular back flushing of the filter medium by reversal of the pressure over the filter element is necessary.

A problem in almost all the systems described above is the build-up of a (thick) filter cake. Only at extremely low pressure drops (and corresponding extremely low filtration rates) cake building may be substantially absent. A growing layer of cake decreases the filtration rate, and therefore needs to be removed in order to maintain an acceptable filtration rate. Many ways to remove the filter cake have been described, for instance by using mass forces (e.g. by using a centrifuge), mechanical cake removal (scrapers, doctor blades etc.), reverse flow and vibration.

It would be useful to carry out the Fischer-Tropsch hydrocarbon synthesis in a three phase slurry reactor in such a way that no filter cake is built up on the filter element or a thin, stable cake layer only is built up which layer does not hamper the filtration process. In this way continuous processing would be possible for 1000 hours and more without the need to remove filter cake.

SUMMARY OF THE INVENTION

The present invention relates to a process for the preparation of liquid hydrocarbons which process comprises contacting synthesis gas with a slurry of solid catalyst particles and a liquid in a reactor vessel by introducing the synthesis gas at a low level into the slurry at conditions suitable for conversion of the synthesis gas into liquid hydrocarbons, the solid catalyst particles comprising a catalytic active metal selected from cobalt or iron on a porous refractory oxide carrier, preferably selected from silica, alumina, titania, zirconia or mixtures thereof, the catalyst being present in an amount between 10 and 40 vol. percent based on total slurry volume liquids and solids, and separating liquid material from the solid catalyst particles by using a filtration system comprising an asymmetric filtration medium (the selective side at the slurry side), in which filtration system the average pressure differential over the filtration medium is at least 0.1 bar, and in which process the particle size distribution is such that at least a certain amount of the catalyst particles is smaller than the average pore size of the selective layer of the filtration medium.

DETAILED DESCRIPTION OF THE INVENTION

A major advantage of the above process is that a very stable filtrate flux is obtained, while no cake layer is built up on the filter element or a thin, stable cake layer only is built up which does not hamper the filtration process, thus making cake removal operations superfluous. This makes simple, continuous operation possible for prolonged periods of time, i.e. 2000 or 3000 hours and more, of a Fischer-Tropsch process. A stable, high flux rate is obtained, no back flushing is necessary.

The solid catalyst particles to be used in the process according to the present invention preferably comprises titania or silica as the porous carrier. Minor amounts of other refractory oxides, e.g. for use as binder, may be present in the carries, e.g. up to 10 wt percent, preferably up to 6 wt percent, more preferably up to 2 wt percent, on total carrier weight. Suitable minor refractory oxides are silica, alumina, titania, ceria and gallia. The carrier typically has a surface area between 50 $m^2/g$ and 400 $m^2/g$, preferably between 100 $m^2/g$ and 300 $m^2/g$. The porosity of the carrier is typically between 30 percent and 80 percent, preferably between 40 percent and 70 percent.

The catalytically active metal is preferably cobalt. The optimum amount of catalytically active metal present on the carrier is typically in the range of 1 to 100 parts by weight per 100 parts by weight of the carrier, preferably from 10 to 50 parts by weight. The catalytically active metal may be present in the catalyst together with one or more promoters. The promoters may be present as metals or as the metal oxides, depending upon the particular promoter. Suitable promoters include oxides of metals from Groups IIA, IIIB, IVB, VB, VIB and/or VIIb of the Periodic Table of Elements, as well as oxides of the lanthanides and/or actinides. Preferably, the catalysts comprises at least one oxide of an element in Group IVB, Vb, and/or VIIb, in particular zirconium, manganese vanadium and/or titanium. Preferred metal promoters include rhenium, platinum and palladium.

A very suitable catalyst comprises cobalt and zirconium, or cobalt and manganese or cobalt and vanadium.

The promoter, if present, is typically present in an amount of 0.1 to 60 parts by weight, preferably 1 to 30 parts by weight, of carrier material. It will be appreciated that the optimum amount may vary for each combination of metal, carrier and promoter.

Typically the catalyst is present in an amount between 15 and 35 vol. percent based on total slurry volume liquids and solids, especially between 18 and 32 vol. percent, more especially between 21 and 29 vol. percent.

The solid particles present in the slurry are kept in suspension in the vessel by means of a gas and/or a liquid superficial velocity, or by means of a mechanical mixing device. Thus, it will be appreciated that the maximum possible average particle size of the solid particles may inter alia depend on the gas and liquid velocity, and the density difference between the solid particles and the liquid. Typically, the average particle size is not greater than 1000 micron, preferably not greater than 600 micron. To allow efficient filtration, typically the average particle size is not smaller than 1 micron, preferably not smaller than 3 micron, more preferably not smaller than 5 micron. The optimum average solid particle size is between 10 and 400 micron, especially between 20 and 200 micron. Very good results were obtained for average particle sizes between 25 and 65 micron. The average particle diameter and the particle size distribution is to be determined by ASTM method 4464-00, laser light diffraction, method D[4,3], especially using commercial equipment provided by Malvern.

If desired a mixture of catalyst particles and other solid particles may be used. The other particles may have an average particle size which is different from the average catalyst particle size. Various options have been discussed in e.g. EP 450,859.

Suitably the amount of catalyst particles smaller than the average pore size of the selective layer of the filtration medium is at least 1 wt percent on the total amount of catalyst particles. Preferably, the amount of catalyst particles smaller than the average pore size of the selective layer of the filtration medium is at least 3 wt percent of en the total amount of catalyst particles, preferably 10 percent, especially between 5 and 20 percent more especially between 7 and 15 percent. The upper limit is suitably 40% wt, preferably 30%, more preferably 25%. Due to attrition, the average (catalyst) particle size may decrease with time during operation of the process. The amount of catalyst particles smaller than the average pore size of the selective layer of the filtration medium is preferably present at the start of the process. However, the process may also be started without the particles smaller than the average pore size. Attrition, breakage etc. will result in the formation of the necessary fineness after some time.

The liquid present in the slurry is normally at least in part, and preferably substantially completely, i.e. more than 90 v/v percent, especially more than 96 v/v percent, the reaction product of the hydrocarbon synthesis reaction. It will be appreciated that if the liquid is only in part a reaction product, further known separation steps, such as adsorption or distillation, may be necessary to isolate the reaction product. It is especially at the start of the reaction that a different liquid may be present. This liquid is preferably a hydrocarbon product obtained from crude oil processing or, preferably, obtained in a Fischer Tropsch reaction.

The filtration system used in the present invention usually will comprise one or more tubular filtration elements, i.e. tubes wherein at least part of the wall of each tube forms the filtration system. Very suitably the whole wall forms the filtration system. Preferably these tubular filtration elements have a length between 0.2 and 10 meter, preferably between 0.5 and 5 meter, and have a diameter between 0.5 and 10 cm, preferably between 1 and 5 cm. Asymmetric filters may be built up of several layers of increasing average pore size or may comprise one layer in which the pore size continuously increases. In the case of woven metals, several layers may be used having increased average pore size. Polymer based membranes may show the continuously increasing pore size. The selective side is the side having the smallest average pore size.

The filtration may be carried out inside the reactor (internal filtration) or outside the reactor (external filtration). A number of tubular elements, e.g. between 10 and 100, may be grouped together to form a filtration unit, the unit comprising one inlet and one outlet.

In the case of internal filtration the superficial gas velocity around the filter elements is preferably between 5 and 40 cm/s, especially between 12 and 35 cm/s. Internal filtration is preferred over external filtration.

In the case of external filtration suitably a cross flow filtration unit will be used. The linear flow velocity in the cross flow unit is typically between 0.5 and 6 m/s, preferably between 1 and 4 m/s.

Typically the filtration system to be used in the present invention comprises fine wired metal screens, especially woven metal screens, or porous ceramic elements. The average pore size of the selective side is between 0.1 and 50 micron, preferably between 0.5 and 30 microns, more especially between 1 and 20 microns. The ratio of the average pore size of the selective side and the average pore size at the other side is usually between 1.2 and 10, preferably between 1.5 and 5.

The driving force in the filtration is the pressure drop across the filter. Typically the average pressure differential over the filtration medium is between 0.2 and 20 bara, especially between 0.5 and 15 bara. The rate of filtration is suitably between $10^{-6}$ and $10^{-2}$ m/s/bar, preferably between $5.10^{-6}$ and $5.10^{-3}$ m/s/bar, preferably $5.10^{-5}$ and $5.10^{-4}$ m/s/bar.

The hydrocarbon synthesis is preferably carried out at a temperature in a range between 150 and 350° C., preferably between 170 and 300° C., more preferably between 200 and 275° C. The pressure preferably ranges from 5 to 80 bara, more preferably from 20 to 60 bara.

Hydrogen and carbon monoxide (synthesis gas) is typically fed to the process at a molar ratio between 0.4 and 2.5. Preferably, the hydrogen to carbon monoxide ratio is between 1.0 and 2.5. The average superficial gas velocity in the process is suitably between 1 and 40 cm/s. The synthesis gas preferably contains 75 vol % or more of hydrogen and carbon monoxide, preferably 90 vol % or more. The synthesis gas may contain one or more inert compounds, e.g. nitrogen (when air or enriched air is used for the production of the synthesis gas) and carbon dioxide (e.g. in the case of a gas recycle). The synthesis gas is preferably introduced by means of one or more spargers at the bottom of the reactor.

The superficial liquid velocity is kept in the range from 0.001 to 4.0 cm/s, including liquid production. Preferably the superficial liquid velocity is between 0.005 and 1.0 cm/s.

Any percentage mentioned in this description is calculated on total weight or volume of the composition, unless indicated differently. When not mentioned, percentages are considered to be weight percentages. Pressures are indicated in bar absolute, unless indicated differently.

EXAMPLE

A three phase slurry reactor was used containing Fischer Tropsch hydrocarbon wax and an activated Fischer Tropsch cobalt on titania catalyst (20 vol % based on total slurry). The temperature 181° C., and the pressure was 41 bara. A superficial gas velocity of 13 cm/s was used. A commercial three layer woven metal filter unit was placed in the reactor (ID 14 mm, length 2 m), selective layer pore size 10 micron. The catalyst comprised about 3 wt % of catalyst particles smaller than 10 micron. An uninterrupted filtration run was carried out for 402 hours, using a pressure difference over the membrane of 0.8–1.4 bar to create a continuous filter performance of $13.10^{-5}$ m/s/bar. The filtrate flux was $15.10^{-3}$ m/s.

We claim:

1. A process for the preparation of liquid hydrocarbons which process comprises contacting synthesis gas with a slurry of solid catalyst particles and a liquid in a reactor vessel by introducing the synthesis gas at a low level into the slurry under conditions suitable for conversion of the synthesis gas into liquid hydrocarbons, the solid catalyst particles comprising a catalytically active metal selected from cobalt or iron on a porous refractory oxide carrier, the catalyst being present in an amount between 10 and 40 vol. percent based on total slurry volume liquids and solids, and separating liquid material from the solid catalyst particles by using a filtration system comprising an asymmetric filtration medium with a selective side at the slurry side, which filtration system comprises one or more tubular filtration elements, in which filtration system the average pressure differential over the filtration medium is at least 0.1 bar, in which process the particle size distribution is such that at least 1 wt percent of the catalyst particles, based on the total amount of catalyst particles, is smaller than the average pore size of the selective layer of the filtration medium.

2. The process of claim 1, in which the porous refractory oxide carrier is selected from the group consisting of silica, alumina, titania, zirconia or mixtures thereof.

3. The process of claim 1, in which the catalytically active metal is cobalt.

4. The process of claim 1, in which the catalyst is present in an amount between 15 and 35 vol. percent based on total slurry volume liquids and solids.

5. The process of claim 1, in which the amount of catalyst particles smaller than the average pore size of the selective layer of the filtration medium is at least 3 wt percent, based on the total amount of catalyst particles.

6. The process of claim 1, in which the amount of catalyst particles smaller than the average pore size of the selective layer of the filtration medium is present at the start of the process.

7. The process of claim 1, in which the tubular filtration elements of the filtration system have a length between 0.2 and 10 meter, and have a diameter between 0.5 and 10 cm.

8. The process of claim 1, in which the filtration system used is an external, cross flow filtration system, in which the linear flow velocity is between 0.5 and 6 m/s.

9. The process of claim 1, in which the filtration system comprises fine wired metal screens, woven metal screens, or porous ceramic elements.

10. The process of claim 1, in which the average pressure differential over the filtration medium is between 0.2 and 20 bara, and in which the rate of filtration is between $5.10^{-6}$ and $5.10^{-3}$ m/s/bar.

11. The process of claim 1, which the average pore size of the selective layer of the filtration medium is between 0.1 and 50 micron.

12. The process of claim 1, in which the average pore size of the selective layer of the filtration medium is between 0.5 and 30 microns.

13. A process for the preparation of liquid hydrocarbons which process comprises contacting synthesis gas with a slurry of solid catalyst particles and a liquid in a reactor vessel by introducing the synthesis gas at a low level into the slurry under conditions suitable for conversion of the synthesis gas into liquid hydrocarbons, the solid catalyst particles comprising a catalytically active metal selected from cobalt or iron on a porous refractory oxide carrier, the catalyst being present in an amount between 10 and 40 vol. percent based on total slurry volume liquids and solids; and separating liquid material from the solid catalyst particles by using a filtration system comprising an asymmetric filtration medium with a selective side at the slurry side, which filtration system comprises one or more tubular filtration elements, in which filtration system the average pressure differential over the filtration medium is at least 0.1 bar and the rate of filtration is between $5.10^{-6}$ and $5.10^{-3}$ m/s/bar, in which process the particle size distribution is such that at least 1 wt percent of the catalyst particles, based on the total amount of catalyst particles, is smaller than the average pore size of the selective layer of the filtration medium.

14. The process of claim 13, in which the catalytically active metal is cobalt.

15. The process of claim 13, in which the catalyst is present in an amount between 15 and 35 vol. percent based on total slurry volume liquids and solids.

16. The process of claim 13, in which the amount of catalyst particles smaller than the average pore size of the selective layer of the filtration medium is at least 3 wt percent on the total amount of catalyst particles.

17. The process of claim 13, in which the tubular filtration elements of the filtration system have a length between 0.2 and 10 meter, and have a diameter between 0.5 and 10 cm;

the linear flow velocity is between 0.5 and 6 m/s; and, the average pressure differential over the filtration medium is between 0.2 and 20 bara.

18. The process of claim 13 wherein the conditions and the asymmetric filtration medium are effective to permit an uninterrupted filtration run of 402 hours or more.

19. The process of claim 13, in which the average pore size of the selective layer of the filtration medium is between 0.1 and 50 micron.

20. The process of claim 13, in which the average pore size of the selective layer of the filtration medium is between 0.5 and 30 microns.

21. A process for the preparation of liquid hydrocarbons which process comprises contacting synthesis gas with a slurry of solid catalyst particles and a liquid in a reactor vessel by introducing the synthesis gas at a low level into the slurry under conditions suitable for conversion of the synthesis gas into liquid hydrocarbons, the solid catalyst particles comprising a catalytically active metal selected from cobalt or iron on a porous refractory oxide carrier, the catalyst being present in an amount between 10 and 40 vol. percent based on total shiny volume liquids and solids, and separating liquid material from the solid catalyst particles by using a filtration system comprising an asymmetric filtration medium with a selective side at the slurry side, which filtration system comprises one or more tubular filtration elements, in which filtration system the average pressure differential over the filtration medium is at least 0.1 bar, in which process the particle size distribution is such that at least 1 wt percent of the catalyst particles, based on the total amount of catalyst particles, is smaller than the average pore size of the selective layer of the filtration medium, the conditions and the asymmetric filtration medium being effective to permit an uninterrupted filtration run of 402 hours or more.

22. The process of claim 21 wherein the conditions and the asymmetric filtration medium are effective to permit an uninterrupted filtration run of 1000 hours or more.

23. The process of claim 21, in which the tubular filtration elements of the filtration system have a length between 0.2 and 10 meter, and have a diameter between 0.5 and 10 cm.

24. The process of claim 21, in which the filtration system used is an external, cross flow filtration system, in which the linear flow velocity is between 0.5 and 6 m/s.

25. The process of claim 21, in which the average pressure differential over the filtration medium is between 0.2 and 20 bara.

26. The process of claim 21, in which the average pore size of the selective layer of the filtration medium is between 0.1 and 50 micron.

27. The process of claim 21, in which the average pore size of the selective layer of the filtration medium is between 0.5 and 30 microns.

* * * * *